US011410789B2

(12) United States Patent
Matsumura et al.

(10) Patent No.: US 11,410,789 B2
(45) **Date of Patent: *Aug. 9, 2022**

(54) CORE WIRE FOR MULTI-CORE CABLES AND MULTI-CORE CABLE

(71) Applicant: SUMITOMO ELECTRIC INDUSTRIES, LTD., Osaka (JP)

(72) Inventors: Yutaka Matsumura, Osaka (JP); Shigeyuki Tanaka, Osaka (JP); Taro Fujita, Osaka (JP); Takaya Kohori, Kanuma (JP); Masayuki Ishikawa, Kanuma (JP)

(73) Assignee: SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/376,279

(22) Filed: Jul. 15, 2021

(65) Prior Publication Data

US 2021/0343447 A1 Nov. 4, 2021

Related U.S. Application Data

(63) Continuation of application No. 16/969,438, filed as application No. PCT/JP2018/037489 on Oct. 5, 2018, now Pat. No. 11,101,054.

(30) Foreign Application Priority Data

Mar. 5, 2018 (JP) ..... JP2018-039137

(51) Int. Cl.
*H01B 7/02* (2006.01)
*H01B 3/44* (2006.01)
*H01B 7/295* (2006.01)

(52) U.S. Cl.
CPC ..... *H01B 7/02* (2013.01); *H01B 3/441* (2013.01); *H01B 7/295* (2013.01)

(58) Field of Classification Search
CPC ..... H01B 3/441; H01B 3/0221; H01B 3/44; H01B 3/447; H01B 3/448; H01B 7/02;
(Continued)

(56) References Cited

U.S. PATENT DOCUMENTS 9,928,937 B2 * 3/2018 Tanaka ..... H01B 3/441
2010/0147549 A1 * 6/2010 Shiina ..... H01B 7/295 174/113 C (Continued)

FOREIGN PATENT DOCUMENTS

CN 102867598 A 1/2013
CN 103314049 A 9/2013

(Continued)

OTHER PUBLICATIONS

Dec. 18, 2018 International Search Report issued in International Patent Application No. PCT/JP2018/037489.

(Continued)

*Primary Examiner* — William H. Mayo, III
(74) *Attorney, Agent, or Firm* — Oliff PLC

(57) ABSTRACT

A core wire for multi-core cables includes a conductor obtained by twisting a plurality of elemental wires, and an insulating layer coated on an outer peripheral surface of the conductor. The insulating layer contains polyethylene-based resin as a main component, and the product of a linear expansion coefficient C1 of the insulating layer in the range of 25° C. to −35° C. and an elastic modulus E1 at −35° C., namely (C1×E1), is 0.01 $MPaK^{-1}$ or more and 0.90 $MPaK^{-1}$ or less. The melting point of the polyethylene-based resin is 80° C. or higher and 130° C. or lower.

22 Claims, 3 Drawing Sheets

(58) Field of Classification Search
CPC ..... H01B 7/009; H01B 7/1875; H01B 7/29; H01B 7/30; H01B 7/0208; H01B 11/02
USPC ..... 174/110 R, 110 A–110 PM, 112, 113 R, 174/120 R, 120 AR–121 SR
See application file for complete search history.

(56) References Cited

U.S. PATENT DOCUMENTS

| | | | | |
|---|---|---|---|---|
| 2012/0205136 | A1 | 8/2012 | Moriuchi et al. | |
| 2013/0012396 | A1* | 1/2013 | Masaki | H01B 3/46 505/230 |
| 2013/0280532 | A1 | 10/2013 | Balfour et al. | |
| 2014/0234619 | A1 | 8/2014 | Shan | |
| 2014/0326480 | A1* | 11/2014 | Hashimoto | H01B 7/295 174/113 R |
| 2017/0309370 | A1* | 10/2017 | Tanaka | H01B 7/295 |
| 2017/0309373 | A1 | 10/2017 | Tanaka et al. | |

FOREIGN PATENT DOCUMENTS

| | | | |
|---|---|---|---|
| JP | 2000-119456 | A | 4/2000 |
| JP | 2010-198973 | A | 9/2010 |
| JP | 2011-99084 | A | 5/2011 |
| JP | 2014-220043 | A | 11/2014 |
| JP | 2015-156386 | A | 8/2015 |
| WO | 2012/044523 | A1 | 4/2012 |
| WO | 2017/056278 | A1 | 4/2017 |
| WO | 2017/056279 | A1 | 4/2017 |

OTHER PUBLICATIONS

Nov. 27, 2020 Office Action issued in U.S. Appl. No. 16/969,438.
Nov. 14, 2017 Notice of Allowance issued in U.S. Appl. No. 15/517,640.
Apr. 15, 2021 Notice of Allowance issued in U.S. Appl. No. 16/969,438.

* cited by examiner

CORE WIRE FOR MULTI-CORE CABLES AND MULTI-CORE CABLE

TECHNICAL FIELD

The present disclosure relates to a core wire for multi-core cables and a multi-core cable. The present application is a continuation application of U.S. application Ser. No. 16/969,438 filed on Aug. 12, 2020, which is a PCT National Phase Application of PCT/JP2018/037489 filed on Oct. 5, 2018, which claims the benefit of priority to Japanese Patent Application No. 2018-039137 filed on Mar. 5, 2018, the entire contents of which are incorporated herein by reference.

BACKGROUND ART

A composite cable for an automobile such as a cable for an electric parking brake (EPB) or for a wheel speed sensor is complicatedly bent in accordance with the installation inside the automobile or the driving of an actuator. Therefore, the bending resistance is important in the properties of a composite cable for an automobile such as a cable for an electric parking brake or for a wheel speed sensor.

In addition, the composite cable mentioned above may be used in such an environment that has a low temperature of 0° C. or lower. Under such a low temperature, the insulating layer will shrink and thereby will repeatedly compress the conductor housed inside. The repeated compression may break the conductor, making it unable to conduct electricity. Conventionally in the prior art, in order to improve the bending resistance in a temperature range of a low temperature to room temperature or higher, there has been proposed an insulating layer that contains a copolymer of ethylene and α-olefin having a carbonyl group as a main component (See WO 2017/056278).

CITATION LIST

Patent Literature

PTL 1: WO 2017/056278

SUMMARY OF INVENTION

A core wire for multi-core cables according to an embodiment of the present disclosure includes a conductor obtained by twisting a plurality of elemental wires, and an insulating layer coated on an outer peripheral surface of the conductor. The insulating layer contains polyethylene-based resin as a main component, the product of a linear expansion coefficient C1 of the insulating layer in the range of 25° C. to −35° C. and an elastic modulus E1 at −35° C., namely (C1×E1) is 0.01 $MPaK^{-1}$ or more and 0.90 $MPaK^{-1}$ or less, and the melting point of the polyethylene-based resin is 80° C. or higher and 130° C. or lower.

DETAILED DESCRIPTION

Figure 1:
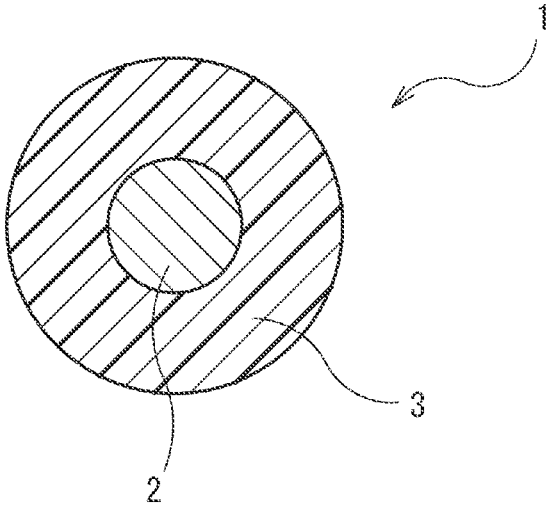
FIG. 1 is a cross-sectional view schematically illustrating a core wire for multi-core cables according to a first embodiment of the present disclosure.

Problem to be Solved by the Present Disclosure

The present inventors have found that even if the conductor is repeatedly bent at room temperature or higher where the conductor is hardly broken, wear or cracking may occur in the insulating material, making the conductor unable to conduct electricity. Such wear or cracking of the insulating material is caused by the interfacial friction between core wires in the same sheath, the interfacial friction between the sheath and the core wires, or the interfacial friction between a wrapping sheet and the core wires in the case of a sheet wrapping structure. In addition, when a fatigue fracture occurs in the insulating material due to repeated bending, the conductor may be exposed from the fracture, causing a problem in conducting electricity. Therefore, it is required to improve the bending resistance not only at a low temperature but also at room temperature or higher.

The present invention has been made in view of the problems mentioned above, and an object thereof is to provide a core wire for multi-core cables and a multi-core cable formed from the core wire excellent in bending resistance not only at a low temperature but also at room temperature or higher.

Advantageous Effects of the Present Disclosure

The core wire for multi-core cables according to an embodiment of the present disclosure is excellent in bending resistance in a temperature range of a low temperature to room temperature or higher.

DESCRIPTION OF EMBODIMENTS OF THE PRESENT DISCLOSURE

A core wire for multi-core cables according to an embodiment of the present disclosure includes a conductor obtained by twisting a plurality of elemental wires and an insulating layer coated on an outer peripheral surface of the conductor, the insulating layer contains polyethylene-based resin as a main component, the product of a linear expansion coefficient C1 of the insulating layer in the range of 25° C. to −35° C. and an elastic modulus E1 at −35° C., namely (C1×E1) is 0.01 $MPaK^{-1}$ or more and 0.90 $MPaK^{-1}$ or less, and the melting point of the polyethylene-based resin is 80° C. or higher and 130° C. or lower.

In the core wire for multi-core cables, since the insulating layer contains polyethylene-based resin as a main component, and the product of the linear expansion coefficient and the elastic modulus of the insulating layer at a low temperature is defined in the above range, the core wire exhibits relatively high bending resistance at a low temperature. The possible reason may be that since at least one of the linear expansion coefficient or the elastic modulus in a temperature range of a low temperature to room temperature or higher is relatively small, the hardening (which may decrease flexibility) that is caused by the shrinkage of the insulating layer at a low temperature is reduced, which thereby increases the bending resistance in a temperature range of a low temperature to room temperature or higher. Further, since the melting point of the polyethylene-based resin is 80° C. or higher and 130° C. or lower, the melting point of the insulating layer is higher than the temperature of the environment where it is used, and thereby, the mechanical properties such as the wear resistance and the strength of the insulating layer as well as the bending resistance at room temperature or higher may be improved. Therefore, the multi-core cable is excellent in wear resistance and bending resistance in a temperature range of a low temperature to room temperature or higher.

In the present disclosure, the "linear expansion coefficient" is measured in accordance with the test method of dynamic mechanical properties described in JIS-K7244-4 (1999), and is calculated from dimensional changes of a thin plate relative to temperature changes which are determined by using a viscoelasticity measuring device (for example, "DVA-220" manufactured by IT Measurement & Control Co., Ltd.) in a tension mode under conditions of a temperature range of −100° C. to 200° C., a temperature rising rate of 5° C./min, a frequency of 10 Hz, and a strain of 0.05%. The "elastic modulus" is measured in accordance with the test method of dynamic mechanical properties described in JIS-K7244-4 (1999), and is calculated from a storage elastic modulus which is determined by using a viscoelasticity measuring device (for example, "DVA-220" manufactured by IT Measurement & Control Co., Ltd.) in a tension mode under conditions of a temperature range of −100° C. to 200° C., a temperature rising rate of 5° C./min, a frequency of 10 Hz, and a strain of 0.05%. The "main component" refers to a substance which has the highest content among the substances constituting the insulating layer, and preferably a substance which has a content of 50% by mass or more. In addition, the bending resistance refers to such a property that the conductor is not broken even though the electric wire or cable is repeatedly bent.

It is preferable that the insulating layer has an elastic modulus E2 of 100 MPa or more at 25° C. By setting the elastic modulus E2 of the insulating layer in the above range, it is possible to improve the wear resistance and the bending resistance thereof.

It is preferable that the insulating layer has a linear expansion coefficient C2 of $5.0\times10^{-4}$ $K^{-1}$ or less in the range of 25° C. to 80° C. By setting the linear expansion coefficient C2 of the insulating layer in the above range, it is possible to reduce the contact pressure between the insulating layers in the sheath which is resulted from the expansion of the insulating layers when the temperature becomes equal to or higher than the room temperature, and thereby reduce the interfacial friction between the insulating layers.

It is preferable that the average area of the conductor in the cross section is 1.0 $mm^2$ or more and 3.0 $mm^2$ or less. By setting the average area of the conductor in the cross section in the above range, the core wire may be suitably used in a multi-core cable for a vehicle.

It is preferable that the average diameter of the plurality of elemental wires in the conductor is 40 μm or more and 100 μm or less, and it is preferable that the number of the plurality of wires is 196 or more and 2450 or less. By setting the average diameter and the number of the elemental wires in the respective range, it is possible to further improve the bending resistance of the core wire in a temperature range of a low temperature to room temperature or higher.

It is preferable that the conductor is obtained by twisting a plurality of wire strands, each of which is obtained by twisting a plurality of elemental wires. By using a conductor (i.e., a double-twisted wire strand) which is obtained by twisting a plurality of wire strands, each of which is obtained by twisting a plurality of elemental wires as described above, it is possible to improve the bending resistance of the core wire.

A multi-core cable according to another embodiment of the present disclosure includes a cable core obtained by twisting a plurality of core wires, and a sheath layer provided around the cable core, and at least one of the plurality of core wires is the core wire for multi-core cables.

Since the multi-core cable includes a cable core that is formed from the core wires mentioned above, the multi-core cable is excellent in bending resistance in a temperature range of a low temperature to room temperature or higher.

It is preferable that at least one of the plurality of core wires is a core wire strand which is obtained by twisting a plurality of core wires. By including a core wire strand in the cable core, it is possible to use the multi-core cable in various applications while maintaining the bending resistance.

DETAILS OF EMBODIMENTS OF THE PRESENT DISCLOSURE

Hereinafter, a core wire for multi-core cables and a multi-core cable according to embodiments of the present disclosure will be described in detail with reference to the drawings.

First Embodiment

A core wire 1 illustrated in FIG. 1 is an insulated wire to be used for preparing a multi-core cable that includes a cable core and a sheath layer provided around the cable core. The cable core is obtained by twisting the core wires 1. The core wire 1 includes a conductor 2 in the form of a wire and an insulating layer 3 which is a protective layer coated on the outer peripheral surface of the conductor 2.

The cross-sectional shape of the core wire 1 is not particularly limited, it may be circular, for example. When the cross-sectional shape of the core wire 1 is circular, the average outer diameter may be, for example, 1 mm or more and 10 mm or less according to different applications. The method for measuring the average outer diameter of the cross section of the core wire is not particularly limited. For example, a caliper is used to measure the outer diameter of the core wire at any 3 positions, and the average value of the outer diameters measured at 3 positions may be used as the average outer diameter.

Conductor

The conductor 2 is obtained by twisting a plurality of elemental wires at a constant pitch. The elemental wire is not particularly limited, and for example, it may be a copper wire, a copper alloy wire, an aluminum wire, or an aluminum alloy wire. Preferably, the conductor 2 is a double-twisted wire strand which is obtained by twisting a plurality of wire strands, each of which is obtained by twisting a plurality of elemental wires. Each wire strand is preferably obtained by twisting the same number of elemental wires.

The number of elemental wires may be appropriately chosen according to the usage of the multi-core cable, the diameter of the elemental wire or the like, and the lower limit of the number of elemental wires is preferably 196, and more preferably 294. On the other hand, the upper limit of the number of elemental wires is preferably 2450, and more preferably 2000. As an example, the double-twisted wire strand may be a double-twisted wire strand that is obtained by twisting 196 elemental wires, specifically obtained by twisting 7 twisted wire strands, each of which is obtained by twisting 28 elemental wires; a double-twisted wire strand that is obtained by twisting 294 elemental wires, specifically obtained by twisting 7 twisted wire strands, each of which is obtained by twisting 42 elemental wires; a double-twisted wire strand that is obtained by twisting 380 elemental wires, specifically obtained by twisting 19 twisted wire strands, each of which is obtained by twisting 20 elemental wires; a triple-twisted wire strand that is obtained by twisting 1568 elemental wires, specifically obtained by twisting 7 double-twisted wire strands (each includes 224 elemental wires), each of which is obtained by twisting 7 twisted wire strands, each of which is obtained by twisting 32 elemental wires; or a triple-twisted wire strand that is obtained by twisting 2450 elemental wires, specifically obtained by twisting 7 double-twisted wire strands (each includes 350 elemental wires), each of which is obtained by twisting 7 twisted wire strands, each of which is obtained by twisting 50 elemental wires.

The lower limit of the average diameter of the elemental wires is preferably 40 μm, more preferably 50 μm, and further preferably 60 μm. On the other hand, the upper limit of the average diameter of the elemental wires is preferably 100 μm, more preferably 90 μm. If the average diameter of the elemental wires is smaller than the lower limit or greater than the upper limit, the bending resistance of the core wire 1 may not be sufficiently improved. The method for measuring the average diameter of the elemental wire is not particularly limited. For example, a micrometer which is provided with two cylindrical anvils is used to measure the diameter of the elemental wire at any 3 positions, and the average value of the diameters measured at 3 positions may be used as the average diameter.

The lower limit of the average area (including the gap between the wires) of the conductor 2 in the cross section is preferably 1.0 $mm^2$, more preferably 1.5 $mm^2$, further preferably 1.8 $mm^2$, and even more preferably 2.0 $mm^2$. On the other hand, the upper limit of the average area of the conductor 2 in the cross section is preferably 3.0 $mm^2$, and more preferably 2.8 $mm^2$. By setting the average area of the conductor 2 in the cross section in the above range, the core wire 1 may be suitably used in a multi-core cable for a vehicle. The method of calculating the average area of the conductor in the cross section is not particularly limited. For example, a caliper is used to measure the outer diameter of the conductor at any 3 positions without crushing the twisted structure of the conductor, the average value of the outer diameters measured at 3 positions may be used as the average outer diameter, and the average area may be calculated from the average outer diameter.

Insulating Layer

The insulating layer 3 is formed of a composition containing synthetic resin as a main component, and is coated on the outer peripheral surface of the conductor 2 to cover the conductor 2. The average thickness of the insulating layer 3 is not particularly limited, and it may be 0.1 mm or more and 5 mm or less, for example. In the present disclosure, the "average thickness" refers to the average value of the thickness measured at any 10 positions. In the following, the term of "average thickness" is applied to the other members in the same definition.

The main component of the insulating layer 3 is polyethylene-based resin. As an example, the polyethylene-based resin may be any polyethylene-based resin such as high-density polyethylene, low-density polyethylene, linear low-density polyethylene, or a copolymer of ethylene and α-olefin. As an example of the polyethylene-based resin such as a copolymer of ethylene and α-olefin, an ethylene-vinyl acetate copolymer (EVA), an ethylene-ethyl acrylate copolymer (EEA), an ethylene-methyl acrylate copolymer (EMA), or an ethylene-butyl acrylate copolymer (EBA) may be given. Among these, the low-density polyethylene or the linear low-density polyethylene is preferably used as the polyethylene-based resin. The polyethylene-based resin may be used alone or a combination of two or more types of polyethylene-based resins. When two or more types of polyethylene-based resins are used in combination, the two or more types of polyethylene-based resins constitute the main component of the insulating layer 3. When two or more types of polyethylene-based resins are used, in order to balance characteristics such as elasticity at low and high temperatures, it is preferable to use a combination of HDPE and LDPE, a combination of HDPE and LLDPE, a combination of HDPE and EVA, or the like. In this case, the content of HDPE relative to the total content of the polyethylene-based resins is preferably 10% by mass or more and 50% by mass or less. It is also preferable to use a combination of EVA and LDPE, a combination of EVA and LLDPE, or the like. In this case, the content of EVA relative to the total content of the polyethylene-based resins is preferably 10% by mass or more and 50% by mass or less.

The lower limit of the melting point of the polyethylene-based resin is 80° C., preferably 85° C., and more preferably 90° C. On the other hand, the upper limit of the melting point is 130° C., preferably 120° C., and more preferably 110° C. If the melting point is lower than the lower limit, the melting point may be lower than the temperature of the use environment, and thereby, sufficient mechanical properties such as the wear resistance and the strength at room temperature or higher may not be obtained. On the contrary, if the melting point is greater than the upper limit, the fatigue fracture and cracking is likely to occur, and thereby, sufficient bending resistance may not be obtained. If a mixture of two or more types of polyethylene-based resins is used in the core wire for multi-core cables, the melting point of the mixture is required to be in the range mentioned above. For example, when two types of polyethylene-based resins are mixed, if the melting point of one polyethylene-based resin is within the melting point range mentioned above and the melting point of the other polyethylene-based resin is higher than 130° C., the mixture may be used as long as the melting point of the mixture is in the range mentioned above. In this case, if the polyethylene-based resin which has the melting point within the melting point range mentioned above is used as the main component (50% by mass or more) of the polyethylene-based resin mixture, the melting point of the mixture may be adjusted within the melting point range mentioned above.

The lower limit of the content of the polyethylene-based resin is preferably 50% by mass, and more preferably 70% by mass. On the other hand, the upper limit of the content of the polyethylene-based resin is preferably 100% by mass, and more preferably 90% by mass. If the content of the polyethylene-based resin is smaller than the lower limit, the bending resistance in a temperature range of a low temperature to room temperature or higher may be insufficient.

The lower limit of the product C1×E1 of the linear expansion coefficient C1 of the insulating layer 3 in the range of 25° C. to −35° C. and the elastic modulus E1 at −35° C. is 0.01 $MPaK^{-1}$. On the other hand, the upper limit of the product C1×E1 is 0.9 $MPaK^{-1}$, preferably 0.8 $MPaK^{-1}$, and more preferably 0.7 $MPaK^{-1}$. If the product C1×E1 is smaller than the lower limit, the mechanical properties such as the strength of the insulating layer 3 may be insufficient. On the contrary, if the product C1×E1 is greater than the upper limit, the insulating layer 3 is less likely to be deformed at a low temperature, and as a result, the bending resistance of the core wire 1 at a low temperature may be insufficient. Note that the product C1×E1 may be adjusted by adjusting the types, the content or the like of the polyethylene-based resins.

The lower limit of the linear expansion coefficient C1 of the insulating layer 3 in the range of 25° C. to −35° C. is preferably $1.0\times10^{-5}$ $K^{-1}$, and more preferably $1.0\times10^{-4}$ $K^{-1}$. On the other hand, the upper limit of the linear expansion coefficient C1 of the insulating layer 3 is preferably $2.5\times10^{-4}$ $K^{-1}$, and more preferably $2.0\times10^{-4}$ $K^{-1}$. If the linear expansion coefficient C1 of the insulating layer 3 is smaller than the lower limit, the mechanical properties such as the strength of the insulating layer 3 may be insufficient. On the contrary, if the linear expansion coefficient C1 of the insulating layer 3 is greater than the upper limit, the insulating layer 3 is less likely to be deformed at a low temperature, and as a result, the bending resistance of the core wire 1 at a low temperature may be insufficient.

The lower limit of the elastic modulus E1 of the insulating layer 3 at −35° C. is preferably 1000 MPa, and more preferably 2000 MPa. On the other hand, the upper limit of the elastic modulus E1 of the insulating layer 3 is preferably 3500 MPa, and more preferably 3000 MPa. If the elastic modulus E1 of the insulating layer 3 is smaller than the lower limit, the mechanical properties such as the strength of the insulating layer 3 may be insufficient. On the contrary, if the elastic modulus E1 of the insulating layer 3 is greater than the upper limit, the insulating layer 3 is less likely to be deformed at a low temperature, and as a result, the bending resistance of the core wire 1 at a low temperature may be insufficient.

The lower limit of the linear expansion coefficient C2 of the insulating layer 3 in the range of 25° C. to 80° C. is preferably $1.0\times10^{-4}$ $K^{-1}$, and more preferably $2.0\times10^{-4}$ $K^{-1}$. On the other hand, the upper limit of the linear expansion coefficient C2 of the insulating layer 3 is preferably 5.0×10 $K^{-1}$, and more preferably $4.5\times10^{-4}$ K. If the linear expansion coefficient C2 of the insulating layer 3 is smaller than the lower limit, the compression on the conductor is less likely to be relaxed at room temperature or higher, and as a result, the bending resistance of the conductor may be insufficient. On the contrary, if the linear expansion coefficient C2 of the insulating layer 3 is greater than the upper limit, due to the expansion of the insulating layers when the temperature becomes equal to or higher than the room temperature, the contact pressure between the insulating layers in the sheath may become greater, which may wear out the insulating layers, and as a result, the conductor is exposed, causing a problem in conducting electricity.

The lower limit of the elastic modulus E2 of the insulating layer 3 at 25° C. is preferably 100 MPa, and more preferably 200 MPa. On the other hand, the upper limit of the elastic modulus E2 of the insulating layer 3 is preferably 1000 MPa, and more preferably 800 MPa. If the elastic modulus E2 of the insulating layer 3 is smaller than the lower limit, the wear resistance is poor and the bending resistance may be insufficient. On the contrary, if the elastic modulus E2 of the insulating layer 3 is greater than the upper limit, the bending rigidity of the cable increases, and as a result, the flexibility of the conductor may be insufficient.

The lower limit of the elastic modulus E3 of the insulating layer 3 at 80° C. is preferably 50 MPa, and more preferably 100 MPa. On the other hand, the upper limit of the elastic modulus E3 of the insulating layer 3 is preferably 300 MPa, and more preferably 200 MPa. If the elastic modulus E3 of the insulating layer 3 is smaller than the lower limit, the wear resistance is poor and the bending resistance may be insufficient. On the contrary, if the elastic modulus E3 of the insulating layer 3 is greater than the upper limit, the bending rigidity of the cable increases, and as a result, the flexibility of the conductor may be insufficient.

The insulating layer 3 may contain an additive such as a flame retardant, an auxiliary flame retardant, an antioxidant, a lubricant, a colorant, a reflection imparting reagent, a masking reagent, a processing stabilizer, or a plasticizer. Further, the insulating layer 3 may contain another resin in addition to the polyethylene-based resin.

The upper limit of the content of another resin is preferably 50% by mass, more preferably 30% by mass, and further preferably 10% by mass. In addition, the insulating layer 3 is not required to contain another resin.

As an example, the flame retardant may be a halogen-based flame retardant such as a bromine-based flame retardant or a chlorine-based flame retardant, or a non-halogen-based flame retardant such as a metal hydroxide, a nitrogen-based flame retardant or a phosphorus-based flame retardant. The flame retardant may be used alone or in combination of two or more types of flame retardants.

As an example of the bromine-based flame retardant, decabromodiphenyl ethane or the like may be given. As an example of the chlorine-based flame retardant, chlorinated paraffin, chlorinated polyethylene, chlorinated polyphenol, perchlorpentacyclodecane, or the like may be given. As an example of the metal hydroxide, magnesium hydroxide or aluminum hydroxide may be given. As an example of the nitrogen-based flame retardant, melamine cyanurate, triazine, isocyanurate, urea, guanidine or the like may be given. As an example of the phosphorus-based flame retardant, metal phosphinate, phosphaphenanthrene, melamine phosphate, ammonium phosphate, phosphate ester, or polyphosphazene may be given.

The lower limit of the content of the flame retardant in the insulating layer 3 is preferably 10 parts by mass, and more preferably 50 parts by mass relative to 100 parts by mass of the resin component. On the other hand, the upper limit of the content of the flame retardant is preferably 200 parts by mass, and more preferably 130 parts by mass. If the content of the flame retardant is smaller than the lower limit, the flame retardant effect may be insufficient. On the contrary, if the content of the flame retardant is greater than the upper limit, the insulating layer 3 is difficult to be formed through extrusion molding, and the mechanical properties such as the elongation and tensile strength may be impaired.

It is preferable that the resin component of the insulating layer 3 is cross-linked. As an example method of cross-linking the resin component of the insulating layer 3, a method of irradiating the resin component with an ionizing radiation beam, a method of using a thermal cross-linking agent such as an organic peroxide, or a method of adding a silane coupling agent to induce a silane-grafting reaction may be given.

Manufacturing Method of Core Wire for Multi-Core Cables

The core wire 1 for multi-core cables may be manufactured by a manufacturing method including a step of twisting a plurality of elemental wires (twisting step) and a step of coating the insulating layer 3 on an outer peripheral surface of the conductor 2 which is obtained by twisting a plurality of elemental wires (insulating layer coating step).

As an example method for coating the outer peripheral surface of the conductor 2 with the insulating layer 3, a method of extruding a composition for forming the insulating layer 3 to the outer peripheral surface of the conductor 2 may be given.

In addition, the method for manufacturing the core wire 1 for multi-core cables may further include a step of cross-linking the resin component of the insulating layer 3 (cross-linking step). The cross-linking step may be performed before coating the conductor 2 with the composition for forming the insulating layer 3 or may be performed after the coating (after the formation of the insulating layer 3).

The cross-linking may be performed by irradiating the composition with an ionizing radiation beam. As the ionizing radiation beam, for example, γ-ray, an electron beam, X-ray, a neutron beam, a high energy ion beam or the like may be used. The lower limit of the irradiation dose of the ionizing radiation beam is preferably 10 kGy, and more preferably 30 kGy. On the other hand, the upper limit of the irradiation dose of the ionizing radiation beam is preferably 300 kGy, and more preferably 240 kGy. If the irradiation dose is smaller than the lower limit, the cross-linking reaction may not be promoted sufficiently. On the contrary, if the irradiation dose is greater than the upper limit, the resin component may be decomposed.

Advantages

The core wire 1 has improved bending resistance in a temperature range of a low temperature to room temperature or higher while maintaining insulation.

Second Embodiment

Figure 2:
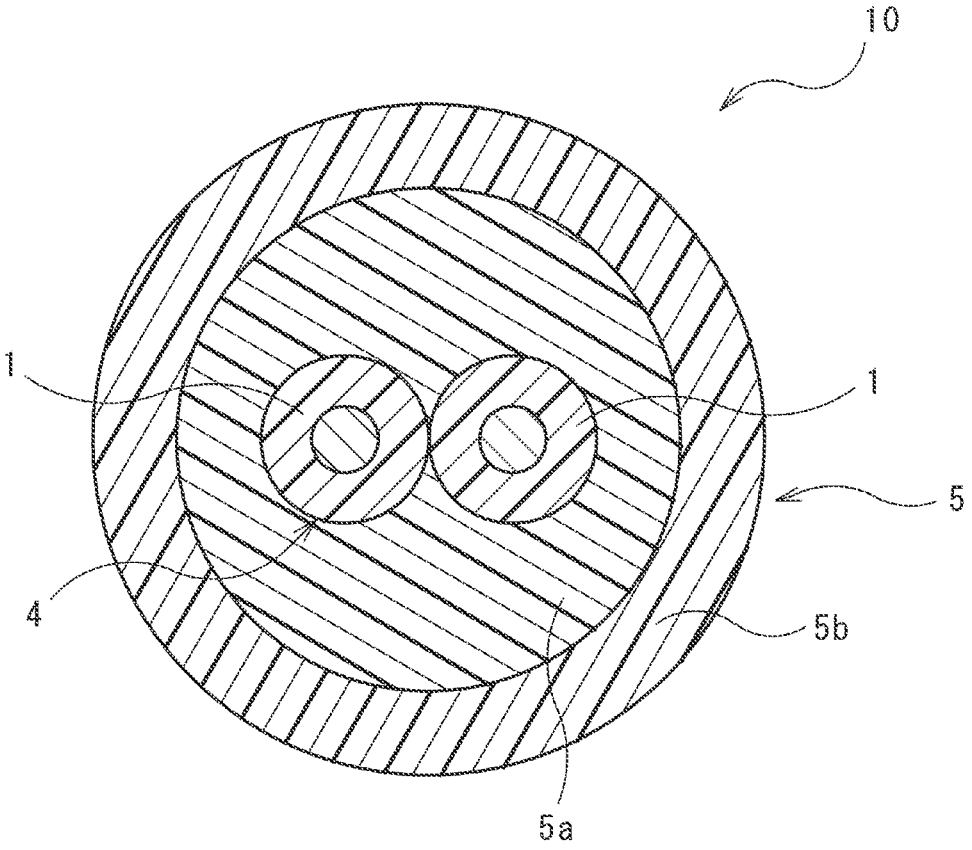
FIG. 2 is a cross-sectional view schematically illustrating a multi-core cable according to a second embodiment of the present disclosure.

A multi-core cable 10 illustrated in FIG. 2 includes a cable core 4 which is obtained by twisting a plurality of the core wires 1 illustrated in FIG. 1, and a sheath layer 5 which is provided around the cable core 4. The sheath layer 5 has an inner sheath layer (intervening layer) 5*a* and an outer sheath layer (outer coating) 5*b*. The multi-core cable 10 may be suitably used as a cable for transmitting an electrical signal to a motor that drives a brake caliper of an electric parking brake.

The outer diameter of the multi-core cable 10 may be appropriately adjusted according to various applications. The lower limit of the outer diameter is preferably 6 mm, and more preferably 8 mm. On the other hand, the upper limit of the outer diameter of the multi-core cable 10 is preferably 16 mm, more preferably 14 mm, further preferably 12 mm, and particularly preferably 10 mm.

Cable Core

The cable core 4 is obtained by twisting two of the core wires 1 having the same diameter in pairs. Each core wire 1 includes the conductor 2 and the insulating layer 3 as described above.

Sheath Layer

The sheath layer 5 has a two-layer structure that includes the inner sheath layer 5*a* laminated on the outer surface of the cable core 4 and the outer sheath layer 5*b* laminated on the outer peripheral surface of the inner sheath layer 5*a*.

The main component of the inner sheath layer 5*a* is not particularly limited as long as it is a synthetic resin having flexibility, and examples thereof include polyolefin such as polyethylene and EVA, polyurethane elastomer, polyester elastomer, and the like. These resins may be used as a mixture of two or more types.

The lower limit of the minimum thickness of the inner sheath layer 5*a* (the minimum distance between the cable core 4 and the outer peripheral surface of the inner sheath layer 5*a*) is preferably 0.3 mm, and more preferably 0.4 mm. On the other hand, the upper limit of the minimum thickness of the inner sheath layer 5*a* is preferably 0.9 mm, and more preferably 0.8 mm. In addition, the lower limit of the outer diameter of the inner sheath layer 5*a* is preferably 6.0 mm, and more preferably 7.3 mm. On the other hand, the upper limit of the outer diameter of the inner sheath layer 5*a* is preferably 10 mm, and more preferably 9.3 mm.

The main component of the outer sheath layer 5*b* is not particularly limited as long as it is a synthetic resin that is excellent in flame retardancy and wear resistance, and as an example, polyurethane may be given.

The average thickness of the outer sheath layer 5*b* is preferably 0.3 mm or more and 0.7 mm or less.

The resin component in each of the inner sheath layer 5*a* and the outer sheath layer 5*b* is preferably cross-linked. The method of cross-linking the inner sheath layer 5*a* and the outer sheath layer 5*b* may be the same as the method of cross-linking the insulating layer 3.

The inner sheath layer 5*a* and the outer sheath layer 5*b* may contain the example additives in the insulating layer 3.

Note that a flat member such as paper may be wound between the sheath layer 5 and the cable core 4 as a winding preventer.

Manufacturing Method of Multi-Core Cable

The multi-core cable 10 may be manufactured by a manufacturing method including a step of twisting a plurality of the core wires 1 (twisting step), and a step of coating a sheath layer on the outer surface of the cable core 4 which is obtained by twisting a plurality of the core wires 1 (sheath layer coating step).

Figure 3:
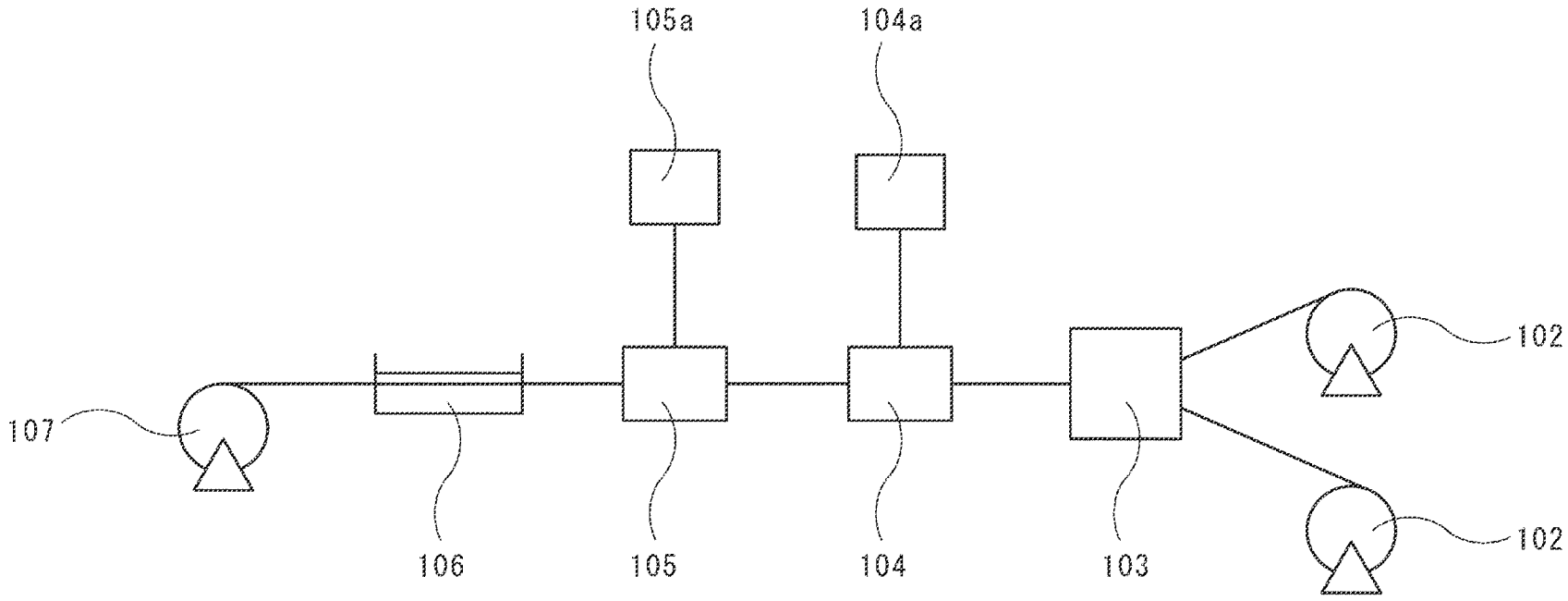
FIG. 3 is a view schematically illustrating an apparatus for manufacturing the multi-core cable according to the present disclosure.

The manufacturing method of the multi-core cable may be performed using a multi-core cable manufacturing apparatus illustrated in FIG. 3. The multi-core cable manufacturing apparatus is mainly equipped with a plurality of core wire supplying reels 102, a twisting unit 103, an inner sheath layer coating unit 104, an outer sheath layer coating unit 105, a cooling unit 106, and a cable winding reel 107.

Twisting Step

In the twisting step, the core wires 1 wound around the plurality of core wire supplying reels 102 are supplied respectively to the twisting unit 103, and the plurality of core wires 1 are twisted by the twisting unit 103 to form the cable core 4.

Sheath Layer Coating Step

In the sheath layer coating step, the inner sheath layer coating unit 104 extrudes a resin composition stored in a storage tank 104*a* so as to coat the inner sheath layer on the outer surface of the cable core 4 formed by the twisting unit 103. As a result, the outer surface of the cable core 4 is coated with the inner sheath layer 5*a*.

After coating the inner sheath layer 5*a*, the outer sheath layer coating unit 105 extrudes a resin composition stored in a storage tank 105*a* so as to coat the outer sheath layer on the outer peripheral surface of the inner sheath layer 5*a*. Thus, the outer sheath layer 5*b* is coated on the outer peripheral surface of the inner sheath layer 5*a*.

After coating the outer sheath layer 5*b*, the cable core 4 is cooled in the cooling unit 106 to cure the sheath layer 5, and whereby the multi-core cable 10 is obtained. The multi-core cable 10 is wound by the cable winding reel 107 thereafter.

The method of manufacturing the multi-core cable may further include a step of cross-linking the resin component of the sheath layer 5 (cross-linking step). The cross-linking step may be performed before coating the resin composition for forming the sheath layer 5 on the cable core 4 or after the coating (after the formation of the sheath layer 5).

The cross-linking may be performed by irradiating the resin composition with an ionizing radiation beam in the same manner as irradiating the insulating layer 3 of the core wire 1. The lower limit of the irradiation dose of the ionizing radiation beam is preferably 50 kGy, and more preferably 100 kGy. On the other hand, the upper limit of the irradiation dose of the ionizing radiation beam is preferably 300 kGy, and more preferably 240 kGy. If the irradiation dose is smaller than the lower limit, the cross-linking reaction may not be promoted sufficiently. On the contrary, if the irradiation dose is greater than the upper limit, the resin component may be decomposed.

Advantages

Since the multi-core cable 10 includes the cable core that is formed from the core wires 1 mentioned above, the multi-core cable 10 is excellent in bending resistance in a temperature range of a low temperature to room temperature or higher.

Third Embodiment

Figure 4:
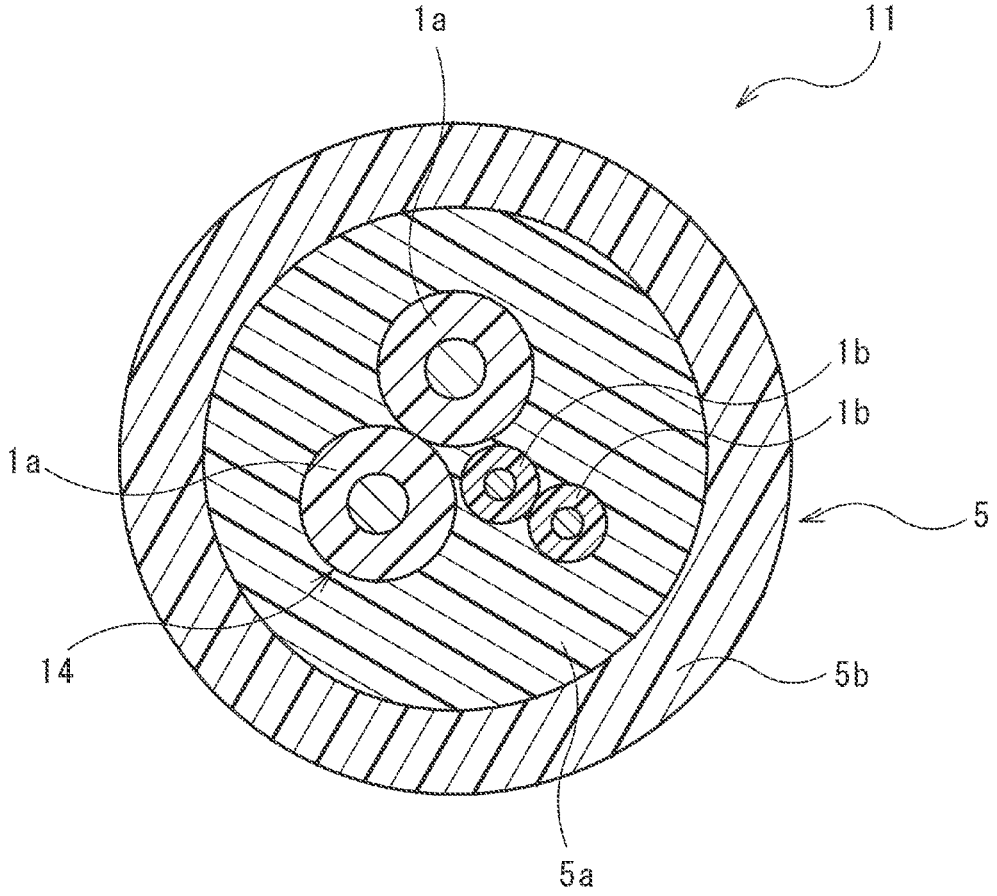
FIG. 4 is a cross-sectional view schematically illustrating a multi-core cable according to a third embodiment of the present disclosure.

A multi-core cable 11 illustrated in FIG. 4 includes a cable core 14 which is obtained by twisting a plurality of the core wires illustrated in FIG. 1, and a sheath layer 5 which is provided around the cable core 14. The multi-core cable 11 is different from the multi-core cable 10 illustrated in FIG. 2 in that the cable core 14 is obtained by twisting a plurality of core wires having different diameters. The multi-core cable 11 may be suitably used not only as a signal cable for an electric parking brake but also as a signal cable for transmitting electrical signals so as to control the operation of an anti-lock brake system (ABS). Since the sheath layer 5 is the same as the sheath layer 5 of the multi-core cable 10 illustrated in FIG. 2, it is assigned with the same reference numeral, and the description thereof will not be repeated.

Cable Core

The cable core 14 is obtained by twisting two of the first core wires 1*a* having the same diameter and two of the second core wires 1*b* having the same diameter but smaller than the diameter of the first core wire 1*a*. Specifically, the cable core 14 is obtained by twisting two of the first core wires 1*a* and one twisted core wire obtained by twisting two of the second core wires 1*b* in pairs. When the multi-core cable 11 is used as a signal cable for a parking brake and an ABS, the twisted core wire obtained by twisting the second core wires 2*b* transmits signals to the ABS.

The first core wire is the same as the core wire 1 illustrated in FIG. 1. The second core wire 1*b* is the same as the first core wire 1*a* in structure except for the different size in the cross section, and the second core wire 1*b* is the same as the first core wire 1*a* in material.

Advantages

The multi-core cable 11 may be used to transmit not only an electrical signal for an electric parking brake mounted on a vehicle but also an electrical signal for an ABS.

Other Modifications

The embodiments in the present disclosure should be considered in all respects as illustrative but not restrictive. The scope of the present disclosure is not limited to the configuration in the embodiments described above but defined by the claims, and is intended to include all modifications within the scope and meaning equivalent to the claims.

The insulating layer of the core wire for the multi-core cable may have a multilayer structure. Further, the sheath layer of the multi-core cable may be a single layer, or may have a multilayer structure of three or more layers.

The multi-core cable may include an electric wire other than the core wire of the present disclosure as the core wire. However, in order to effectively exhibit the effects of the present disclosure, it is preferable that all the core wires in the multi-core cable are the core wire of the present disclosure. The number of the core wires in the multi-core cable is not particularly limited as long as it is two or more, and for example, the number of the core wires may be six or more.

The core wire for the multi-core cable may have a primer layer directly coated on the conductor. As the primer layer, a material obtained by cross-linking a cross-linkable resin such as ethylene containing no metal hydroxide may be suitably used. By providing such a primer layer, it is possible to suppress the detachment of the insulating layer from the conductor over time.

EXAMPLES

Hereinafter, the core wire for multi-core cables and the multi-core cable according to an embodiment of the disclosure will be described in detail with reference to the examples. However, it should be noted that the present disclosure is not limited to the following examples.

Core Wire

An insulating layer-forming composition was prepared according to the formulations listed in Table 1, and a conductor (having an average diameter of 2.4 mm) was prepared by twisting 7 wire strands, each of which is obtained by twisting 72 annealed copper wires having an average diameter of 80 μm. The insulating layer-forming composition was extruded on the outer peripheral surface to form an insulating layer having an outer diameter of 3 mm, and thereby, the core wires of No. 1 to No. 11 were obtained. The insulating layer was irradiated with an electron beam of 120 kGy to cross-link the resin component.

Polyethylene-Based Resin

The polyethylene-based resins used are listed in the following Table 1. The melting point of each resin was measured by using a differential scanning calorimeter (DSC). Specifically, when the temperature was raised at a temperature rising rate of 10° C./min from 25° C. to 200° C. for the first time, and then from 25° C. to 200° C. for the second time, the endothermic peak temperature appeared in the second time was measured as the melting point of each resin.

(1) HDPE1 (high-density polyethylene-based resin) manufactured by Tosoh Corporation, produce name: Nipolon Hard (registered trademark) 6300, melting point: 137° C.;

(2) HDPE2 (high-density polyethylene-based resin) manufactured by Tosoh Corporation, produce name: Nipolon Hard (registered trademark) 6710, melting point: 131° C.;

(3) EVA1 (ethylene-vinyl acetate copolymer) manufactured by Dow-Mitsui Polychemicals, produce name: Evaflex (registered trademark) EV360, melting point: 77° C.;

(4) EVA2 (ethylene-vinyl acetate copolymer) manufactured by Dow-Mitsui Polychemicals, produce name: Evaflex (registered trademark) P1403, melting point: 92° C.;

(5) LDPE (low-density polyethylene-based resin) manufactured by Japan Polyethylene Corporation, produce name: Novatec (registered trademark) LD ZF33, melting point: 108° C.; and (6) LLDPE (linear low-density polyethylene) manufactured by Japan Polyethylene Corporation, produce name: Novatec (registered trademark) LL UE320, melting point: 122° C.

The symbol "-" in Table 1 indicates that the corresponding component was not used.

Additives

The flame retardant 1 in Table 1 is a bromine-based flame retardant (product name: SAYTEX (registered trademark) 8010 manufactured by Albemarle Corporation The flame retardant 2 is antimony trioxide. The antioxidant is Irganox (registered trademark) 1010 manufactured by BASF Corporation.

Multi-Core Cable

A second core wire was formed by twisting 2 core wires, each of which is formed with an insulation layer having an outer diameter of 1.45 mm by extruding a cross-linkable flame-retardant polyolefin on the outer peripheral surface of a conductor (having an average diameter of 0.72 mm) obtained by twisting 60 elemental wires made of copper alloy and having an average diameter of 80 μm. Next, 2 of the core wires of the same kind as that obtained above and the second core wire were twisted to form a cable core, and a sheath layer was coated around the cable core by extrusion to form a multi-core cable. Thereby, the multi-core cables of No. 1 to No. 11 were obtained. The sheath layer was formed to include an inner sheath layer which contains cross-linkable polyolefin as the main component and has a minimum thickness of 0.45 mm and an average outer diameter of 7.4 mm, and an outer sheath layer which contains flame retardant cross-linkable polyurethane as the main component and has an average thickness of 0.5 mm and an average outer diameter of 8.4 mm. The resin components in the sheath layer was cross-linked by irradiation with an electron beam of 180 kGy.

Linear Expansion Coefficient and Elastic Modulus

For the insulating layer in each of the multi-core cables of No. 1 to No. 11, the linear expansion coefficient C1 in the range of 25° C. to −35° C. and the linear expansion coefficient C2 in the range of 25° C. to 80° C. were calculated respectively from dimensional changes of a thin plate relative to temperature changes which are determined in accordance with the test method of dynamic mechanical properties described in JIS-K7244-4 (1999) by using a viscoelasticity measuring device (for example, "DVA-220" manufactured by IT Measurement & Control Co., Ltd.) in a tension mode under conditions of a temperature range of −100° C. to 200° C., a temperature rising rate of 5° C./min, a frequency of 10 Hz, and a strain of 0.05%. The elastic modulus E1 at −35° C., the elastic modulus E2 at 25° C., and the elastic modulus E3 at 80° C. were calculated respectively from a storage elastic modulus which is determined in accordance with the test method of dynamic mechanical properties described in JIS-K7244-4 (1999) by using a viscoelasticity measuring device (for example, "DVA-220" manufactured by IT Measurement & Control Co., Ltd.) in a tension mode under conditions of a temperature range of −100° C. to 200° C., a temperature rising rate of 5° C./min, a frequency of 10 Hz, and a strain of 0.05%. The results are listed in Table 1.

Bending Test

Figure 5:
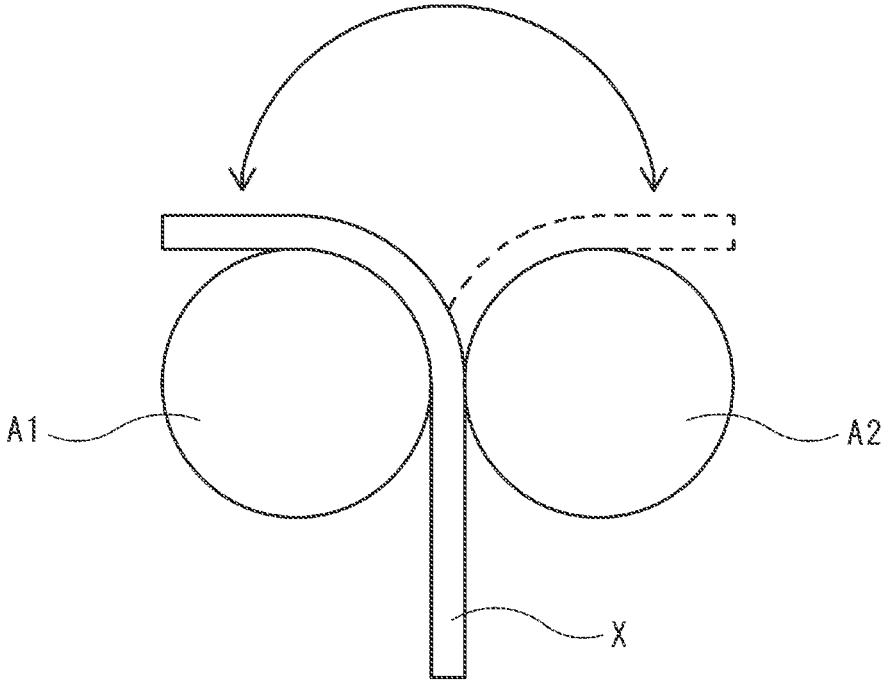
FIG. 5 is a view schematically illustrating a bending test performed in an example.

As illustrated in FIG. 5, each multi-core cable X of No. 1 to No. 11 was pulled in the vertical direction to pass through two mandrels A1 and A2 having a diameter of 60 mm and arranged in parallel with each other in the horizontal direction. The upper end of the multi-core cable X was bent 90° in the horizontal direction so as to contact the upper face of one mandrel A1, and then it was bent 90° to the opposite direction so as to contact the upper face of the other mandrel A2. The bending test was repeated for 10000 times at a bending frequency of 60 times/min with a downward load of 2 kg applied to the lower end of the multi-core cable X under a respective temperature of −35° C. and 80° C. After the bending test, whether the core wire is normal (capable of conducting electricity), broken (incapable of conducting electricity), worn (the insulating material is worn and thereby the conductor is exposed), or cracked (the insulating material is cracked and thereby the conductor is exposed) was checked. The results are listed in Table 1.

TABLE 1

| | | | No. 1 | No. 2 | No. 3 | No. 4 | No. 5 | No. 6 |
|---|---|---|---|---|---|---|---|---|
| Insulating layer | Content of polyethylene-based resin (parts by mass) | HDPE1 | 100 | — | — | — | — | — |
| | | HDPE2 | — | 100 | — | — | — | — |
| | | EVA1 | — | — | 100 | — | — | — |
| | | EVA2 | — | — | — | 100 | — | — |
| | | VLDPE1 | — | — | — | — | — | — |
| | | VLDPE2 | — | — | — | — | — | — |
| | | LDPE | — | — | — | — | 100 | — |
| | | LLDPE | — | — | — | — | — | 100 |

TABLE 1-continued

| | | | | | | | | |
|---|---|---|---|---|---|---|---|---|
| | Melting point of polyethylene-based resin (° C.) | | 137 | 131 | 77 | 92 | 108 | 122 |
| | Content of additives (parts by mass) | Flame retardant 1 | 40 | 40 | 40 | 40 | 40 | 40 |
| | | Flame retardant 2 | 20 | 20 | 20 | 20 | 20 | 20 |
| | | Antioxidant | 2 | 2 | 2 | 2 | 2 | 2 |
| | Properties at low temperature | Linear expansion coefficient ($K^{-1}$) C1 (−35° C. to 25° C.) | $2.7 \times 10^{-4}$ | $2.4 \times 10^{-4}$ | $1.2 \times 10^{-4}$ | $2.6 \times 10^{-4}$ | $2.4 \times 10^{-4}$ | $2.3 \times 10^{-4}$ |
| | | Elastic modulus (MPa) E1 (35° C.) | 3600 | 3200 | 3200 | 3650 | 2500 | 3300 |
| | | C1 × E1 | 1.1 | 0.72 | 0.37 | 0.95 | 0.60 | 0.76 |
| | Properties at room temperature or higher | Linear expansion coefficient ($K^{-1}$) C2 (25° C. to 80° C.) | $5.1 \times 10^{-4}$ | $4.8 \times 10^{-4}$ | $4.3 \times 10^{-4}$ | $2.3 \times 10^{-4}$ | $4.4 \times 10^{-4}$ | $4.0 \times 10^{-4}$ |
| | | Elastic modulus (MPa) E2 (25° C.) | 1600 | 900 | 60 | 200 | 620 | 1000 |
| | | Elastic modulus (MPa) E3 (80° C.) | 320 | 310 | 7 | 50 | 120 | 200 |
| Properties of multi-core cable | | Bending test (10000 times) −35° C. | broken | normal | normal | broken | normal | normal |
| | | Bending test (10000 times) 80° C. | cracked | cracked | worn | normal | normal | normal |

| | | | No. 7 | No. 8 | No. 9 | No. 10 | No. 11 |
|---|---|---|---|---|---|---|---|
| Insulating layer | Content of polyethylene-based resin (parts by mass) | HDPE1 | 60 | 50 | 30 | — | — |
| | | HDPE2 | — | — | — | — | — |
| | | EVA1 | — | — | — | — | — |
| | | EVA2 | — | — | — | — | — |
| | | VLDPE1 | — | — | — | 100 | — |
| | | VLDPE2 | — | — | — | — | 100 |
| | | LDPE | 40 | 50 | 70 | — | — |
| | | LLDPE | — | — | — | — | — |
| | Melting point of polyethylene-based resin (° C.) | | 137 (HDPE1) 108 (LDPE) | 137 (HDPE1) 108 (LDPE) | 137 (HDPE1) 108 (LDPE) | 80 | 93 |
| | Content of additives (parts by mass) | Flame retardant 1 | 40 | 40 | 40 | 40 | 40 |
| | | Flame retardant 2 | 20 | 20 | 20 | 20 | 20 |
| | | Antioxidant | 2 | 2 | 2 | 2 | 2 |
| | Properties at low temperature | Linear expansion coefficient ($K^{-1}$) C1 (−35° C. to 25° C.) | $2.5 \times 10^{-4}$ | $2.5 \times 10^{-4}$ | $2.5 \times 10^{-4}$ | $2.0 \times 10^{-4}$ | $2.0 \times 10^{-4}$ |
| | | Elastic modulus (MPa) E1 (35° C.) | 3100 | 3000 | 2800 | 2200 | 2500 |
| | | C1 × E1 | 0.78 | 0.75 | 0.7 | 0.4 | 0.5 |
| | Properties at room temperature or higher | Linear expansion coefficient ($K^{-1}$) C2 (25° C. to 80° C.) | $4.4 \times 10^{-4}$ | $4.4 \times 10^{-4}$ | $4.4 \times 10^{-4}$ | $2.2 \times 10^{-4}$ | $2.2 \times 10^{-4}$ |
| | | Elastic modulus (MPa) E2 (25° C.) | 1100 | 900 | 800 | 70 | 150 |
| | | Elastic modulus (MPa) E3 (80° C.) | 260 | 220 | 200 | 10 | 12 |
| Properties of multi-core cable | | Bending test (10000 times) −35° C. | normal | normal | normal | normal | normal |
| | | Bending test (10000 times) 80° C. | cracked | normal | normal | normal | normal |

As listed in Table 1, the main component of the insulating layer is polyethylene-based resin, and the product C1×E1 of the linear expansion coefficient C1 of the insulating layer in the range of 25° C. to −35° C. and the elastic modulus E1 at −35° C. is 0.01 $MPaK^{-1}$ or more and 0.90 $MPaK^{-1}$ or less, and the multi-core cables of No. 5, No. 6 and No. 8 to No. 10, each of which contains the polyethylene-based resin having a melting point of 80° C. or higher and 130° C. or lower, exhibited good results in the bending test at both −35° C. and 80° C. without the occurrence of breakage, wear or cracking. From the above results, it was obvious that the multi-core cable according to the examples of the present disclosure is excellent in bending resistance in a temperature range of a low temperature to room temperature or higher.

Oil Resistance Test

The multi-core cables of No. 5, No. 6 and No. 8 to No. 11 were immersed in oil in accordance with the test method for automotive parts: low voltage cables described in JASO No. D618 (2008). Gasoline was used as the oil. The composite cable was cut into a length of about 1 to 2 m, and 25 cm of the sheath layer was stripped from both ends so as to expose the EPB wire and the ABS wire. The EPB wire and the ABS wire were arranged above the oil level so that the oil can enter the portion between the sheath layer and the EPB wire and between the sheath layer and the ABS wire but cannot enter the inner side of the EPB wire or the inner side of the ABS wire. After the oil immersion, the multi-core cable was dried at room temperature for 30 minutes or more, and subjected to the bending test mentioned above for 10000 times at −35° C. and 80° C., respectively. After the bending test, whether the core wire is normal (capable of conducting electricity), broken (incapable of conducting electricity), abraded (the insulating material is abraded and thereby the conductor is exposed), or cracked (the insulating material is cracked and thereby the conductor is exposed) was checked. The results are listed in Table 2.

TABLE 2

| | | | No. 5 | No. 6 | No. 8 |
|---|---|---|---|---|---|
| Insulating layer | Content of polyethylene-based resin (parts by mass) | HDPE1 | — | — | 50 |
| | | HDPE2 | — | — | — |
| | | EVA1 | — | — | — |
| | | EVA2 | — | — | — |

TABLE 2-continued

| | | | | | |
|---|---|---|---|---|---|
| | | VLDPE1 | — | — | — |
| | | VLDPE2 | — | — | — |
| | | LDPE | 100 | — | 50 |
| | | LLDPE | — | 100 | — |
| | Melting point of polyethylene-based resin (° C.) | | 108 | 122 | 137 (HDPE1)<br>108 (LDPE) |
| | Content of additives (parts by mass) | Flame retardant 1 | 40 | 40 | 40 |
| | | Flame retardant 2 | 20 | 20 | 20 |
| | | Antioxidant | 2 | 2 | 2 |
| | Properties at low temperature | Linear expansion coefficient ($K^{-1}$) C1 (−35° C. to 25° C.) | $2.4 \times 10^{-4}$ | $2.3 \times 10^{-4}$ | $2.5 \times 10^{-4}$ |
| | | Elastic modulus (MPa) E1 (35° C.) | 2500 | 3300 | 3000 |
| | | C1 × E1 | 0.60 | 0.76 | 0.75 |
| | Properties at room temperature or higher | Linear expansion coefficient ($K^{-1}$) C2 (25° C. to 80° C.) | $4.4 \times 10^{-4}$ | $4.0 \times 10^{-4}$ | $4.4 \times 10^{-4}$ |
| | | Elastic modulus (MPa) E2 (25° C.) | 620 | 1000 | 900 |
| | | Elastic modulus (MPa) E3 (80° C.) | 120 | 200 | 220 |
| Properties of multi-core cable | | Bending test after oil immersion (10000 times) −35° C. | normal | normal | normal |
| | | Bending test after oil immersion (10000 times) 80° C. | normal | normal | normal |

| | | | No. 9 | No. 10 | No. 11 |
|---|---|---|---|---|---|
| Insulating layer | Content of polyethylene-based resin (parts by mass) | HDPE1 | 30 | — | — |
| | | HDPE2 | — | — | — |
| | | EVA1 | — | — | — |
| | | EVA2 | — | — | — |
| | | VLDPE1 | — | 100 | — |
| | | VLDPE2 | — | — | 100 |
| | | LDPE | 70 | — | — |
| | | LLDPE | — | — | — |
| | Melting point of polyethylene-based resin (° C.) | | 137 (HDPE1)<br>108 (LDPE) | 80 | 93 |
| | Content of additives (parts by mass) | Flame retardant 1 | 40 | 40 | 40 |
| | | Flame retardant 2 | 20 | 20 | 20 |
| | | Antioxidant | 2 | 2 | 2 |
| | Properties at low temperature | Linear expansion coefficient ($K^{-1}$) C1 (−35° C. to 25° C.) | $2.5 \times 10^{-4}$ | $2.0 \times 10^{-4}$ | $2.0 \times 10^{4}$ |
| | | Elastic modulus (MPa) E1 (35° C.) | 2800 | 2200 | 2500 |
| | | C1 × E1 | 0.7 | 0.4 | 0.5 |
| | Properties at room temperature or higher | Linear expansion coefficient ($K^{-1}$) C2 (25° C. to 80° C.) | $4.4 \times 10^{-4}$ | $2.2 \times 10^{-4}$ | $2.2 \times 10^{-4}$ |
| | | Elastic modulus (MPa) E2 (25° C.) | 800 | 70 | 150 |
| | | Elastic modulus (MPa) E3 (80° C.) | 200 | 10 | 12 |
| Properties of multi-core cable | | Bending test after oil immersion (10000 times) −35° C. | normal | normal | normal |
| | | Bending test after oil immersion (10000 times) 80° C. | normal | cracked | cracked |

As listed in Table 2, the multi-core cables of No. 5, No. 6, No. 8 and No. 9 exhibited good results in the bending test at both −35° C. and 80° C. after oil immersion without the occurrence of breakage, wear or cracking, and the multi-core cables of No. 10 and No. 11 exhibited good results in the bending test at −35° C. after oil immersion without the occurrence of breakage, wear or cracking. From the above results, it was obvious that the multi-core cable according to examples of the present disclosure is excellent in bending resistance in a temperature range of a low temperature to room temperature or higher.

REFERENCE SIGNS LIST

1, 1*a*, 1*b*: core wire
2: conductor
3: insulating layer
4, 14: cable core
5: sheath layer
5*a*: inner sheath layer
5*b*: outer sheath layer
10, 11: multi-core cable
102: core wire supplying reel
103: twisting unit
104: inner sheath layer coating unit
104*a*, 105*a*: storage tank
105: outer sheath layer coating unit
106: cooling unit
107: cable winding reel
A1, A2: mandrel
X: multi-core cable

The invention claimed is:

1. A core wire for multi-core cables comprising:

a conductor obtained by twisting a plurality of elemental wires; and an insulating layer coated on an outer peripheral surface of the conductor, the insulating layer containing polyethylene-based resin, and the insulating layer contains at least one flame retardant selected from a group consisting of a bromine-based flame retardant, a chlorine-based flame retardant, and a phosphorus-based flame retardant, wherein:

a product of a linear expansion coefficient C1 of the insulating layer in a range of 25° C. to −35° C. and an elastic modulus E1 at −35° C. (C1×E1) is 0.01 $MPaK^{-1}$ or more and 0.90 $MPaK^{-1}$ or less, a melting point of the polyethylene-based resin is 80° C. or higher and 130° C. or lower, and a content of the flame retardant in the insulating layer is 10 parts by mass or higher and 200 parts by mass or lower relative to 100 parts by mass of the polyethylene-based resin.

2. The core wire for multi-core cables according to claim 1, wherein:

the insulating layer has an elastic modulus E2 of 100 MPa or more at 25° C., and the insulating layer has a second linear expansion coefficient C2 of $5.0\times10^{-4}$ $K^{-1}$ or less in a range of 25° C. to 80° C.

3. The core wire for multi-core cables according to claim 1, wherein the insulating layer is cross-linked.

4. The core wire for multi-core cables according to claim 1, wherein:

an average area of the conductor in a cross section is 1.0 $mm^2$ or more and 3.0 $mm^2$ or less, an average diameter of the plurality of elemental wires in the conductor is 40 μm or more and 100 μm or less, and a number of the plurality of elemental wires is 196 or more and 2450 or less.

5. The core wire for multi-core cables according to claim 1, wherein the conductor is formed by twisting a plurality of wire strands, each of plurality of wire strands being obtained by twisting multiple elemental wires of the plurality of elemental wires.

6. A multi-core cable comprising:

a cable core formed by twisting a plurality of core wires; and a sheath layer provided around the cable core, wherein at least one of the plurality of core wires is the core wire according to claim 1.

7. The multi-core cable according to claim 6, wherein at least one of the plurality of core wires is a core wire strand that is formed by twisting multiple core wires of the plurality of core wires.

8. A core wire for multi-core cables comprising:

a conductor obtained by twisting a plurality of elemental wires; and an insulating layer coated on an outer peripheral surface of the conductor, the insulating layer containing polyethylene-based resin and at least one flame retardant, the polyethylene-based resin being at least one selected from a group consisting of low-density polyethylene, linear low-density polyethylene and ultra-low-density polyethylene, and the at least one flame retardant is selected from a group consisting of a bromine-based flame retardant, a chlorine-based flame retardant, and a phosphorus-based flame retardant, wherein:

a product of a linear expansion coefficient C1 of the insulating layer in a range of 25° C. to −35° C. and an elastic modulus E1 at −35° C., namely (C1×E1) is 0.01 $MPaK^{-1}$ or more and 0.90 $MPaK^{-1}$ or less, the linear expansion coefficient C1 of the insulating layer is $1.0\times10^{-5}$ $K^{-1}$ or more and $2.5\times10^{-4}$ $K^{-1}$ or less, the elastic modulus E1 at −35° C. is 1000 MPa or more and 3500 or less, a melting point of the polyethylene-based resin is 80° C. or higher and 130° C. or lower, and a content of the flame retardant in the insulating layer is 10 parts by mass or higher and 200 parts by mass or lower relative to 100 parts by mass of the polyethylene-based resin.

9. The core wire for multi-core cables according to claim 8, wherein:

the insulating layer has an elastic modulus E2 of 100 MPa or more at 25° C., and the insulating layer has a second linear expansion coefficient C2 of $5.0\times10^{-4}K^{-1}$ or less in a range of 25° C. to 80° C.

10. The core wire for multi-core cables according to claim 8, wherein the insulating layer is cross-linked.

11. The core wire for multi-core cables according to claim 8, wherein:

an average area of the conductor in a cross section is 1.0 $mm^2$ or more and 3.0 $mm^2$ or less, an average diameter of the plurality of elemental wires in the conductor is 40 μm or more and 100 μm or less, and a number of the plurality of elemental wires is 196 or more and 2450 or less.

12. The core wire for multi-core cables according to claim 8, wherein the conductor is formed by twisting a plurality of wire strands, each of plurality of wire strands being obtained by twisting multiple elemental wires of the plurality of elemental wires.

13. A multi-core cable comprising:

a cable core formed by twisting a plurality of core wires; and a sheath layer provided around the cable core, wherein at least one of the plurality of core wires is the core wire according to claim 8.

14. The multi-core cable according to claim 13, wherein at least one of the plurality of core wires is a core wire strand that is formed by twisting multiple core wires of the plurality of core wires.

15. A core wire for multi-core cables comprising:

a conductor obtained by twisting a plurality of elemental wires; and an insulating layer coated on an outer peripheral surface of the conductor, the insulating layer contains polyethylene-based resin, the polyethylene-based resin being a combination of low-density polyethylene and high-density polyethylene, and a content of the high-density polyethylene relative to a total content of the polyethylene-based resins is 10% by mass or more and 50% by mass or less, wherein:

a product of a linear expansion coefficient C1 of the insulating layer in a range of 25° C. to -35° C. and an elastic modulus E1 at −35° C., namely (C1×E1) is 0.01 $MPaK^{-1}$ or more and 0.90 $MPaK^{-1}$ or less, the linear expansion coefficient C1 of the insulating layer is $1.0\times10^{-5}$ $K^{-1}$ or more and $2.5\times10^{-4}$ $K^{-1}$ or less, the elastic modulus E1 at −35° C. is 1000 MPa or more and 3500 or less, and a melting point of the polyethylene-based resin is 80° C. or higher and 130° C. or lower.

16. The core wire for multi-core cables according to claim 15, wherein:

the insulating layer has an elastic modulus E2 of 100 MPa or more at 25° C., and the insulating layer has a second linear expansion coefficient C2 of $5.0\times10^{-4}K^{-1}$ or less in a range of 25° C. to 80° C.

17. The core wire for multi-core cables according to claim 15, wherein:

the insulating layer contains at least one flame retardant selected from a group consisting of a bromine-based flame retardant, a chlorine-based flame retardant, a metal hydroxide, a nitrogen-based flame retardant, and a phosphorus-based flame retardant, and a content of the flame retardant in the insulating layer is 10 parts by mass or higher and 200 parts by mass or lower relative to 100 parts by mass of a resin component.

18. The core wire for multi-core cables according to claim 15, wherein the insulating layer is cross-linked.

19. The core wire for multi-core cables according to claim 15, wherein:

an average area of the conductor in a cross section is 1.0 $mm^2$ or more and 3.0 $mm^2$ or less, an average diameter of the plurality of elemental wires in the conductor is 40 μm or more and 100 μm or less, and a number of the plurality of elemental wires is 196 or more and 2450 or less.

20. The core wire for multi-core cables according to claim 15, wherein the conductor is formed by twisting a plurality of wire strands, each of plurality of wire strands being obtained by twisting multiple elemental wires of the plurality of elemental wires.

21. A multi-core cable comprising:

a cable core formed by twisting a plurality of core wires; and a sheath layer provided around the cable core, wherein at least one of the plurality of core wires being the core wire according to claim 15.

22. The multi-core cable according to claim 21, wherein at least one of the plurality of core wires is a core wire strand that is formed by twisting multiple core wires of the plurality of core wires.

* * * * *